US005830013A

United States Patent [19]

Saito et al.

[11] Patent Number: 5,830,013

[45] Date of Patent: Nov. 3, 1998

[54] ELECTRIC CONNECTOR

[75] Inventors: Hitoshi Saito; Takashi Takagishi, both of Shizuoka, Japan

[73] Assignee: Yazaki Corporation, Tokyo, Japan

[21] Appl. No.: 812,546

[22] Filed: Mar. 7, 1997

[51] Int. Cl.[6] ..... H01R 13/436

[52] U.S. Cl. ..... 439/595; 439/752

[58] Field of Search ..... 439/595, 752

[56] References Cited

U.S. PATENT DOCUMENTS 5,044,991 9/1991 Colleran et al. ..... 439/595
5,122,080 6/1992 Hatagishi et al. ..... 439/595

FOREIGN PATENT DOCUMENTS 4-22079 1/1992 Japan .

*Primary Examiner*—Gary F. Paumen
*Attorney, Agent, or Firm*—Sughrue, Mion, Zinn, Macpeak & Seas, PLLC

[57] ABSTRACT

An electric connector includes a connector housing (A) having a plurality of terminal receiving chambers (5) aligned side by side in at least one lateral row, a through-path (9) formed through one side wall (8) of the housing so as to communicate with the respective terminal receiving chambers and a terminal lock member (B) inserted into the through-path through two stages of a temporary lock position and a normal lock position, the terminal lock member having flexible lock arms (19) for allowing terminals (C) to be inserted into the terminal receiving chambers at the temporary lock position, having lock protrusions for engaging with the terminals at a normal insertion position to prevent the terminals from coming off, and further having fixing lock rods (23) for engaging with the terminals which are in the normal insertion position at the normal lock position, wherein each of the lock protrusions (20) of the flexible lock arms is formed so as to be wide enough to be engageable with two adjacent terminals (C) which are in the normal insertion position at the normal lock position.

12 Claims, 7 Drawing Sheets

ELECTRIC CONNECTOR

BACKGROUND OF THE INVENTION

1. Field of the Invention

The present invention relates to an electric connector for connecting electric cables to each other, and particularly to an improved terminal double-lock structure with a terminal lock member.

2. Related Art

FIGS. 8 to 10 show a prior art of an electric connector using a terminal lock member (U.S. Pat. No. 5,044,991).

In FIG. 8, terminal receiving chambers 32 are formed so as to be sectioned in two, upper and lower, stages in a connector housing 31, and a through-path 33 is formed so as to communicate with the respective terminal receiving chambers from one side wall of the housing so that a terminal lock member 34 can be removably inserted into the through-path. The terminal lock member 34 has a structure in which first flexible latches 35 and second fixed locks 36 are alternately provided so as to correspond to the upper and lower terminal receiving chambers respectively as shown in FIG. 9.

The assembling of the electric connector is carried out such that, in a state where the terminal lock member 34 is inserted into the through-path 33 and held in a temporary lock position, a terminal 39 with an electric cable 37 and a water-proof rubber stopper 38 is inserted from the rear side of the terminal receiving chamber 32.

An electric contact portion 39*a* of the terminal 39 contacts with a saddle-shaped lock protrusion 35*a* at the free end of the first latch 35, and goes forward while pushing down the lock protrusion 35*a*. When the electric contact portion 39*a* gets over the lock protrusion 35*a*, the lock protrusion 35*a* engages with a shoulder portion 39*b* formed at the rear end of the electric contact portion 39*a* by the elastic return of the latch 35 as shown in FIG. 10A to thereby prevent the terminal 39 from coming off.

When the terminal lock member 34 is slid in the direction of arrow P so as to be set in a normal lock position as shown in FIG. 10B after all the terminals 39 are inserted, the shoulder portion 39*b* is separated perfectly from the lock protrusion 35*a*, and engages with the second fixed lock 36.

In a conventional electric connector, as is apparent from FIG. 10B, the engagement between the terminal 39 and the first latch 35 is released perfectly in the normal lock position of the terminal lock member 34. Therefore, at the time of moving the state from FIG. 10A to FIG. 10B, that is, when the terminal lock member 34 moves from the temporary lock position to the normal lock position, there is a fear that if a tension is given to the electric cable 37, the terminal 39 comes off, or engages with the second lock 36 so that the terminal lock member 34 becomes immovable, or in the worst case the terminal 39 is deformed or the lock 36 is broken. In addition, once the lock 36 is broken, the terminal 39 cannot be locked because of lack of engagement of the terminal 39 with the first latch 35.

SUMMARY OF THE INVENTION

Taking the foregoing problems into consideration, the present invention has an object to provide an electric connector in which the locking state of the terminals is maintained even when a terminal lock member moves from a temporary lock position to a normal lock position, and a force to hold the terminals is ensured so that there is no fear that terminals come off even if one of two lock portions such as the above-mentioned latch 35 and lock 36 is damaged.

In order to achieve the above object, according to a first aspect of the present invention, provided is an electric connector comprising: a connector housing having a plurality of terminal receiving chambers aligned side by side in at least one lateral row, a through-path formed through one side wall of the housing so as to communicate with the respective terminal receiving chambers and a terminal lock member inserted into the through-path through two stages of a temporary lock position and a normal lock position, the terminal lock member having flexible lock arms for allowing terminals to be inserted into the terminal receiving chambers at the temporary lock position, having lock protrusions for engaging with the terminals at a normal insertion position to prevent the terminals from coming off, and further having fixing lock rods for engaging with the terminals which are in the normal insertion position at the normal lock position; wherein each of the lock protrusions of the flexible lock arms is formed so as to be wide enough to be engageable with two adjacent terminals which are in the normal insertion position at the normal lock position.

According to a second aspect of the present invention, the terminal lock member includes a lock member body constituted by a side plate portion for closing an opening portion of the through-path, a partition plate portion provided so as to be perpendicular to the side plate portion, and a back plate portion provided at rear ends of the side and partition plate portions, and the flexible lock arms and the fixing lock rods are provided alternately, through slits, from the back plate portion to a front end portion of the partition plate portion.

In the electric connector according to the present invention, since the connector has such a structure that the flexible lock arms of the terminal lock member engage with terminals so as to prevent the terminals from coming off not only in the temporary lock position but also in the normal lock position, the terminal holding force is ensured, and coming-off, damage of the terminals, etc., at the time of assembling of the electric connector can be prevented surely, so that the reliability is improved. In addition, in the normal lock position of the terminal lock member, the opening portion of the through-path in the housing is closed by the side plate portion of the terminal lock member.

According to a third aspect of the present invention, a hook is formed, through a notch, on a front end surface of the partition plate portion of the terminal lock member, a saddle-shaped lock protrusion is formed, through a recess portion, on a rear end surface of the partition plate portion, a lock protrusion is provided to project on one side of the through-path to which the terminal lock member is inserted, and an elastic lock arm having a lock protrusion is provided on the other side of the through-path and the terminal lock member is held in the temporary lock position when the hook on the front end surface of the partition plate portion gets over the lock protrusion in the through-path and the lock protrusion on the rear end surface engages with the lock protrusion of the elastic lock arm, while the terminal lock member is held in the normal lock position when the terminal lock member is further inserted into the inside of the through-path from the temporary lock position and the lock protrusion of the elastic lock arm engages with the recess portion in the rear end surface of the side plate portion. Thus, the terminal lock member is surely held in the temporary lock position/normal lock position by means of the lock protrusion in the through-path and the elastic lock arm.

According to a fourth aspect of the present invention, an unlock-jig insertion hole is provided so as to extend from the front end surface of the connector housing to the lock protrusion of the elastic lock arm facing the through-path. Thus, by inserting a jig into the unlock-jig insertion hole, the normal lock state is released so that the terminal lock member can be returned to the temporary lock position.

According to a fifth aspect of the present invention, a plurality of terminal receiving holes are formed side by side in two, upper and lower stages in the connector housing, portions of the terminal receiving holes in front of the through-path are divided into upper and lower sections by a center partition wall, portions of the terminal receiving holes in the rear of the through-path are sectioned by upper and lower partition walls on the opposite side of a cavity portion, the unlock-jig insertion hole is provided in the center partition wall, and the elastic lock arm having the lock protrusion is provided in the cavity portion. With such a structure of the two stages, that is, the upper and lower stages, of the terminal receiving holes, the partition plate portion of the terminal lock member can be used in common, so that the whole structure can be formed compactly.

According to a sixth aspect of the present invention, preferably, a guide groove for the side plate portion of the terminal lock member is provided in the rear end surface of the center partition wall according to the sixth aspect of the present invention, so that attachment/removal of the terminal lock member can be made smoothly.

DETAILED DESCRIPTION OF THE PREFERRED EMBODIMENTS

Figure 1:
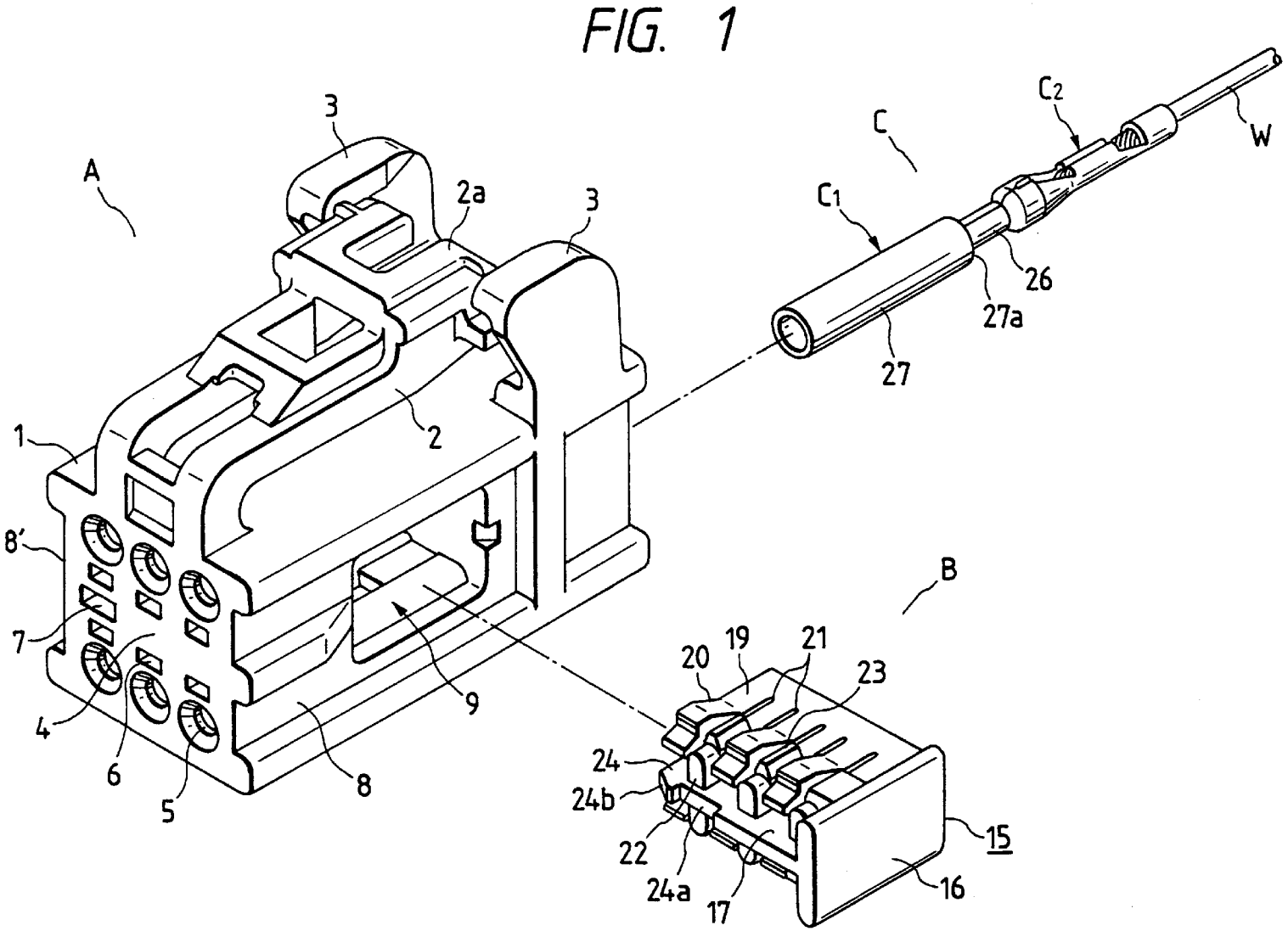
FIG. 1 is a perspective view illustrating an embodiment of an electric connector according to the present invention in a state where parts are separated.
Figure 2:
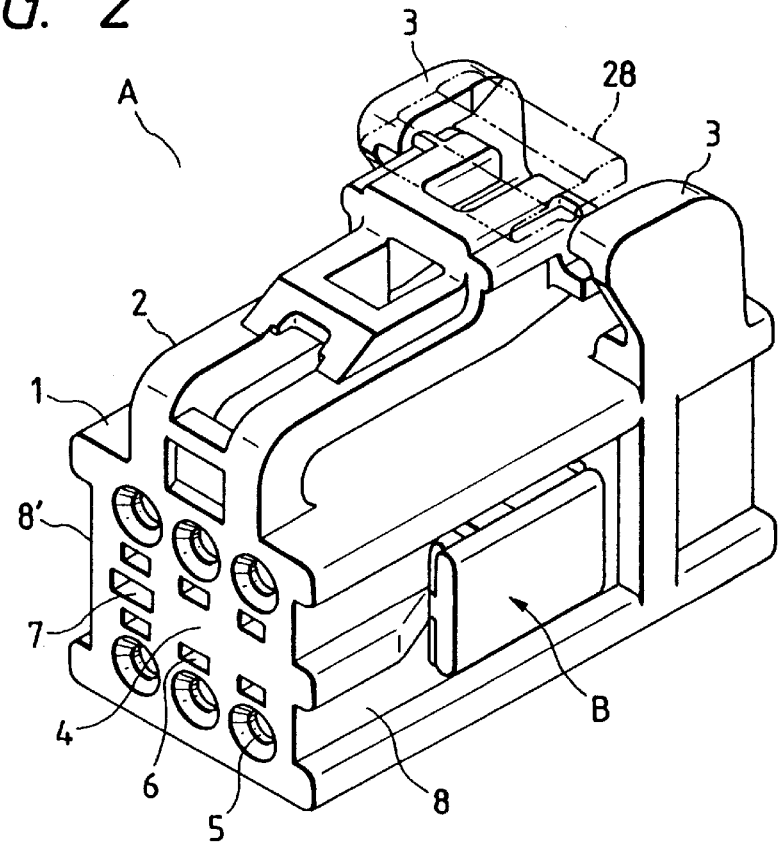
FIG. 2 is a perspective view of the electric connector in an assembled state in FIG. 1.
Figure 3:
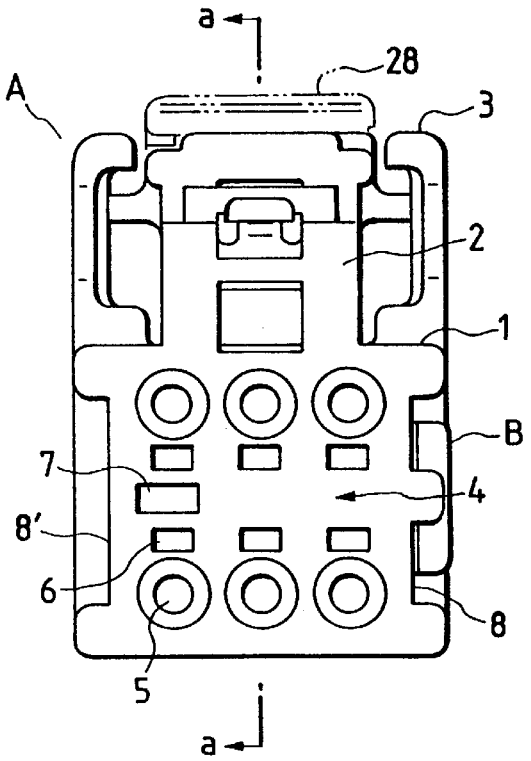
FIG. 3 is a front view of a male connector housing in FIG. 1.
Figure 4:
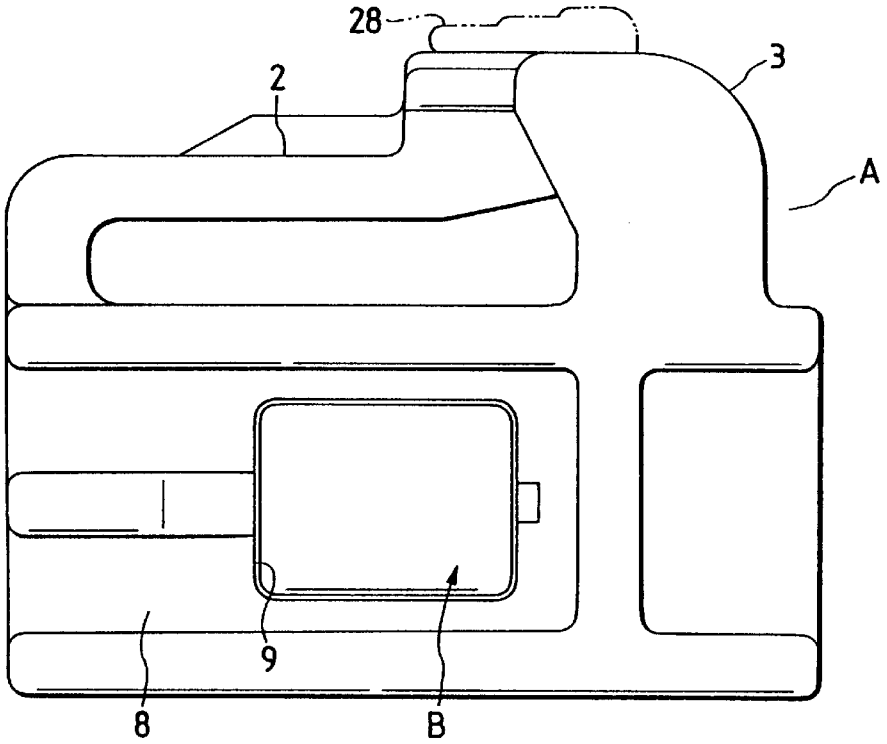
FIG. 4 is a right side view of FIG. 3.

In FIGS. 1 to 6, an electric connector according to the present invention is constituted by a male connector housing A made from synthetic resin, a terminal lock member B and terminals C made from synthetic resin in the same manner respectively. A locking arm 2 for engaging with a not-shown female connector housing is provided on an upper outer circumferential wall 1 of the male connector housing A, and an operation portion 2*a* formed on the free end of the arm 2 is protected by a pair of protective walls 3 and 3 provided on the opposite sides respectively.

Inside the male connector housing A, a plurality of terminal receiving holes 5 are provided side by side in two, upper and lower, stages through a center partition wall 4. In the front half portion of the housing A, terminal-pull-out jig insertion holes 6 are provided between the center partition wall 4 and the respective terminal receiving holes 5, and further, an unlock-jig insertion hole 7 is provided in the end portion of the center partition wall 4.

In addition, a through-path 9 is formed so as to extend from the intermediate of one side wall 8 of the male connector housing A while crossing the upper and lower terminal receiving holes 5 including the center partition wall 4 to thereby communicate with the terminal receiving holes 5 so that the terminal lock member B can be removably attached into the through-path 9. A recess portion 10 for receiving an end portion of the terminal lock member B is provided in the other side wall 8' (see FIG. 6B).

Figure 5:
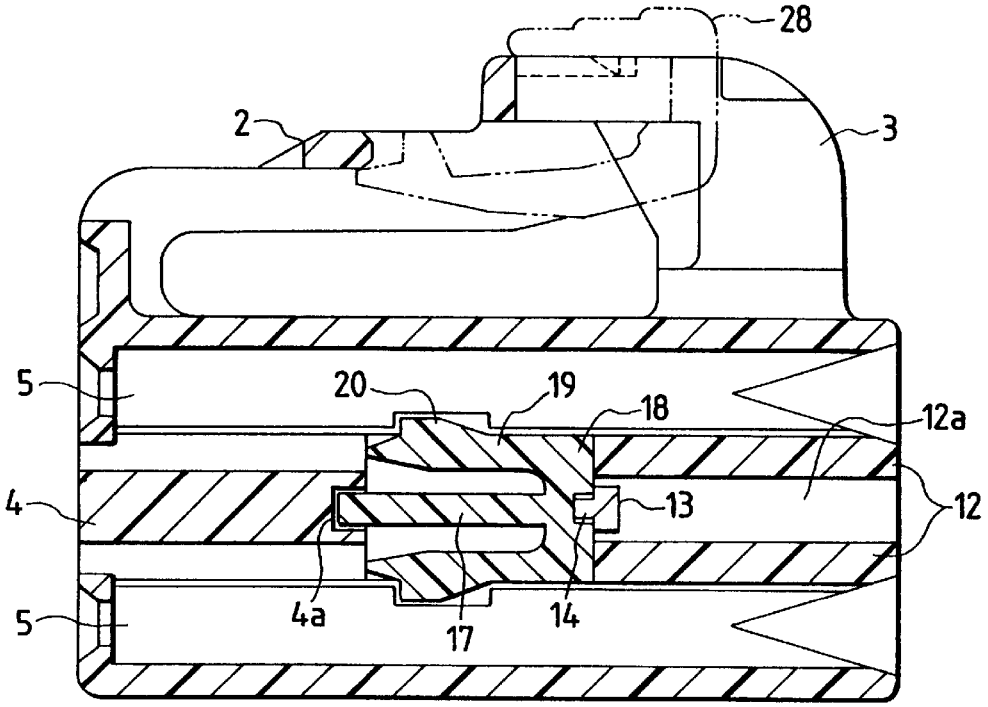
FIG. 5 is a sectional view taken on line a—a in FIG. 3.

In the through-path 9, a guide groove 4*a* for guiding the terminal lock member B is provided in the rear end surface of the center partition wall 4, and a lock protrusion 11 is provided so as to project at the end of the groove 4*a,* that is, on the unlock-jig insertion hole 7 side. In addition, on the rear side of the through-path 9, partition walls 12 and 12 having an upper and lower double structure are provided on the opposite side of a cavity portion 12*a* as shown in FIG. 5. In the cavity portion 12*a,* a cantilever-like elastic lock arm 13 is formed so as to face the center partition wall 4 and so as to be displaceable around a fulcrum portion 13*a* as shown by the arrow Q. A lock protrusion 14 facing almost the center of the unlock-jig insertion hole 7 is provided on the free end of the elastic lock arm 13 so as to project therefrom.

The terminal lock member B is constituted by flexible lock arms 19 and fixing lock rods 23 which are alternately formed on a lock member body 15 so as to correspond to the respective terminal receiving holes 5. Specifically, the lock member body 15 is constituted by a side plate portion 16 for closing the opening portion of the through-path 9, a partition plate portion 17 formed so as to perpendicular to the side plate portions 16, and a back plate portion 18 formed so as to follow the rear ends of the two plate portions 16 and 17. The flexible lock arms 19 and walls 22 supporting the fixing lock rods 23 are provided alternately through slits 21 so as to extend forward from both the upper and lower edges of the back plate portion 18. Preferably, the width do of the supporting walls 22 is formed so as to be almost equal to the width $d_1$ of a partition wall 5*a* between the terminal receiving holes 5 and 5. Consequently, the width $D_0$ of the flexible lock arms 19 can be made wide so as to be almost equal to the diameter $D_1$ of the terminal receiving holes 5, and the width of lock protrusions 20 at their free end portion is also made wide. Although the lower end of the supporting walls 22 are formed integrally with the partition plate portion 17 in the embodiment of FIG. 1, they may be separated if they are rigid bodies substantially without any vertical or horizontal deflection or displacement.

In addition, in the front end surface of the partition plate portion 17 of the lock member body 15, a hook 24 is formed through a notch 24*a* on the side opposite to the side plate portion 16. On the rear end surface, a saddle-shaped lock protrusion 25 is formed through a recess portion 25*a*.

The terminal C has a well-known structure having an electric contact portion $C_1$ in the front of a columnar connecting shaft 26 and an electric-cable connecting portion $C_2$ in the rear of the connecting shaft 26. An electric cable W is pressure-connected in the electric-cable connecting portion $C_2$, and the electric contact portion $C_1$ is formed by a large-diameter bearing cylinder 27 having a stepped portion for receiving a partner-side round pin terminal (not-shown), while the connecting shaft 26 has a small diameter.

Next, the double lock for locking the terminal C by means of the terminal lock member B will be described.

First, the terminal lock member B is inserted into the through-path 9 of the side wall 8 of the male connector housing A so as to be set into a temporary lock state. That is, when the front end surface of the partition plate portion 17 of the lock member body 15 is inserted along the guide groove 4*a* (see FIG. 5) of the center partition wall 4 as shown in FIG. 6B, the elastic lock arm 13 goes forward while contacting with the rear end surface elastically. Then, a front slope 25*b* of the lock protrusion 25 on the rear end side contacts with a rear slope 14*a* of the lock protrusion 14 of the elastic lock arm 13 at the same time as the hook 24 on the front end surface gets over the lock protrusion 11, so that the forward/backward movement of the terminal lock member B is blocked and locked temporarily.

Figure 6A:
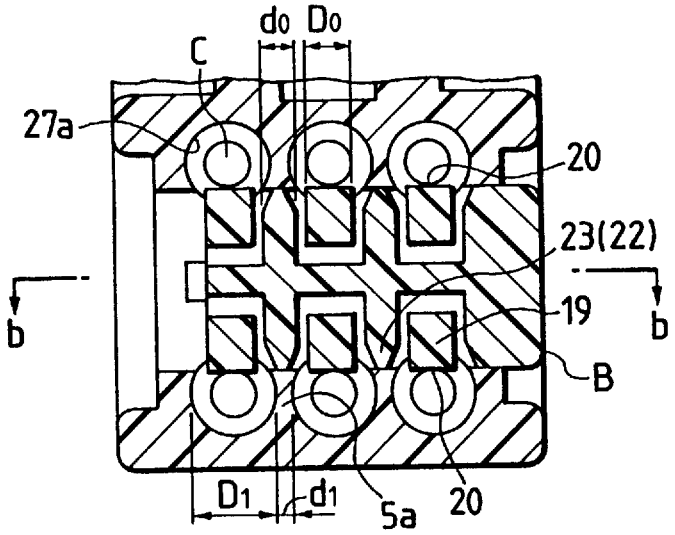
FIG. 6A is a main portion cross-sectional view illustrating the correlation between terminals and flexible lock arms when a terminal lock member in FIG. 1 is locked temporarily.
Figure 6B:
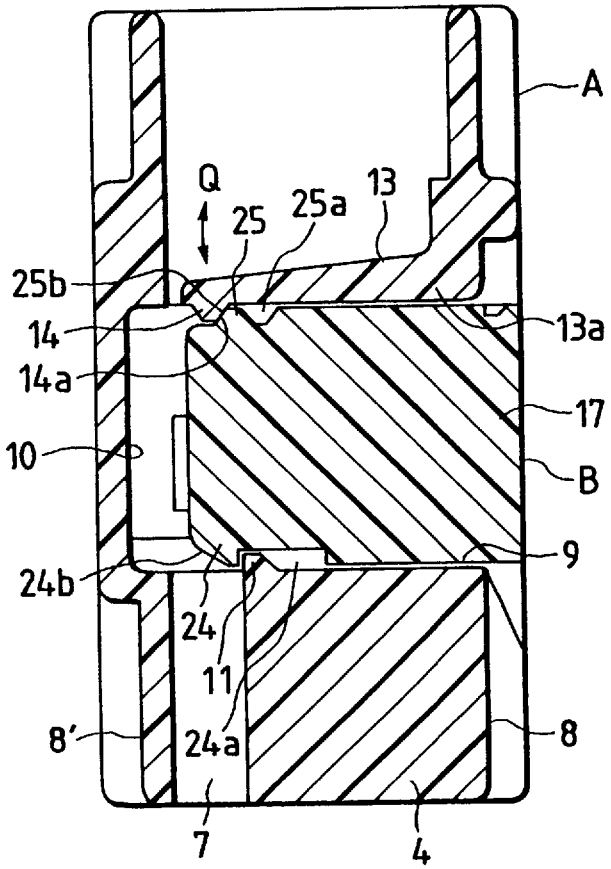
FIG. 6B is a sectional view taken on line b—b in FIG. 6A.

In this temporary lock position, the flexible lock arm 19 is disposed in a state of being stretched fully in the terminal receiving hole 5 as shown in FIG. 6A, and the supporting wall 22 is aligned in a longitudinal line with the partition 5*a* between the terminal receiving holes 5 and 5, so that the terminal C can be inserted into and detached from the terminal receiving hole 5 desirably. In the normal insertion position, the lock protrusion 20 of the flexible lock arm 19 is engaged with the rear edge (shoulder portion 27*a*) of the bearing cylinder 27 by a mechanism which is similar to that in the conventional example, so that the terminal C is locked primarily. Although this primary lock mechanism per se is similar to that in the conventional example, the lock protrusion 20 is wide so that the primary lock is performed with its opposite ends projecting over the shoulder portion 27*a*.

Next, after the insertion and primary lock of all the terminals C, the terminal lock member B is further pushed in and set in a normal lock state. That is, as shown in FIG. 7B, by the movement in the direction of arrow R, the lock protrusion 11 is disposed on the right side of the notch 24*a* while the lock protrusion 14 of the elastic lock arm 13 is fitted into the recess portion 25*a*, so that the terminal lock member B is locked in a normal lock position.

Figure 7A:
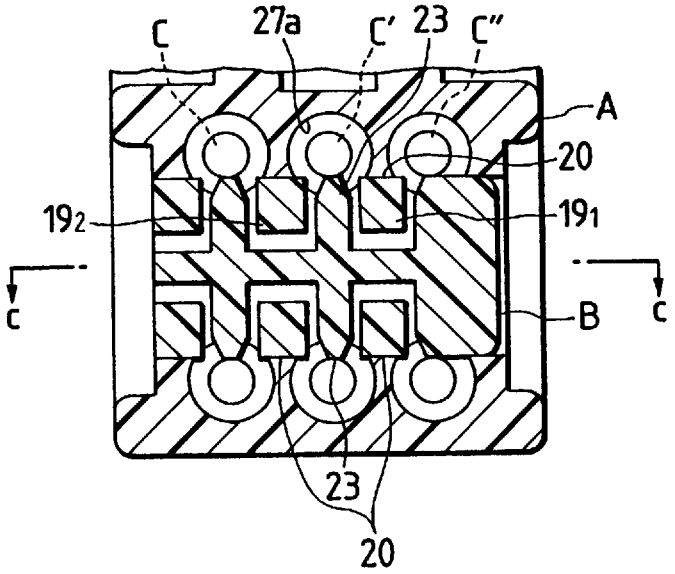
FIG. 7A is a main portion cross-sectional view illustrating the correlation between terminals and flexible lock arms when the terminal lock member in FIG. 1 is locked normally.
Figure 7B:
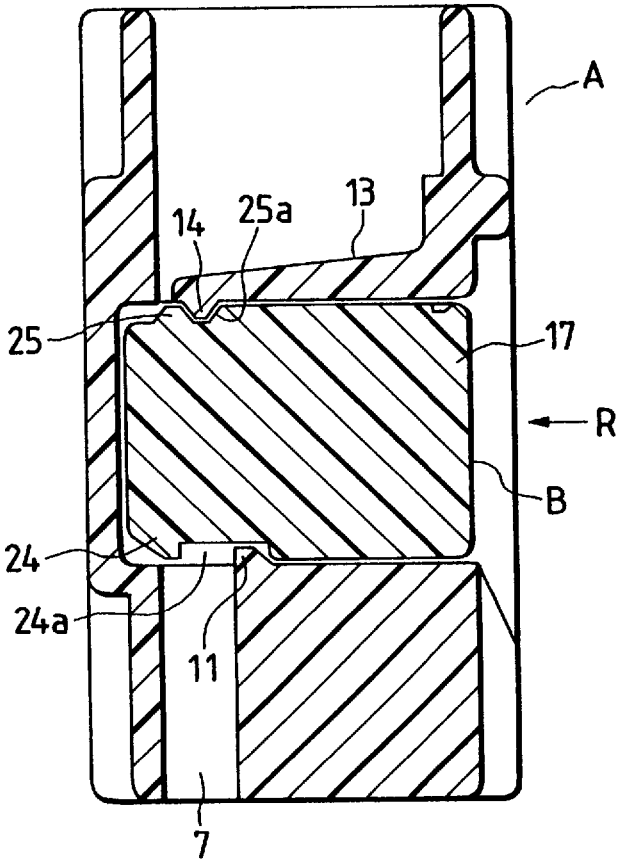
FIG. 7B is a sectional view taken on line c—c in FIG. 7A.
Figure 8:
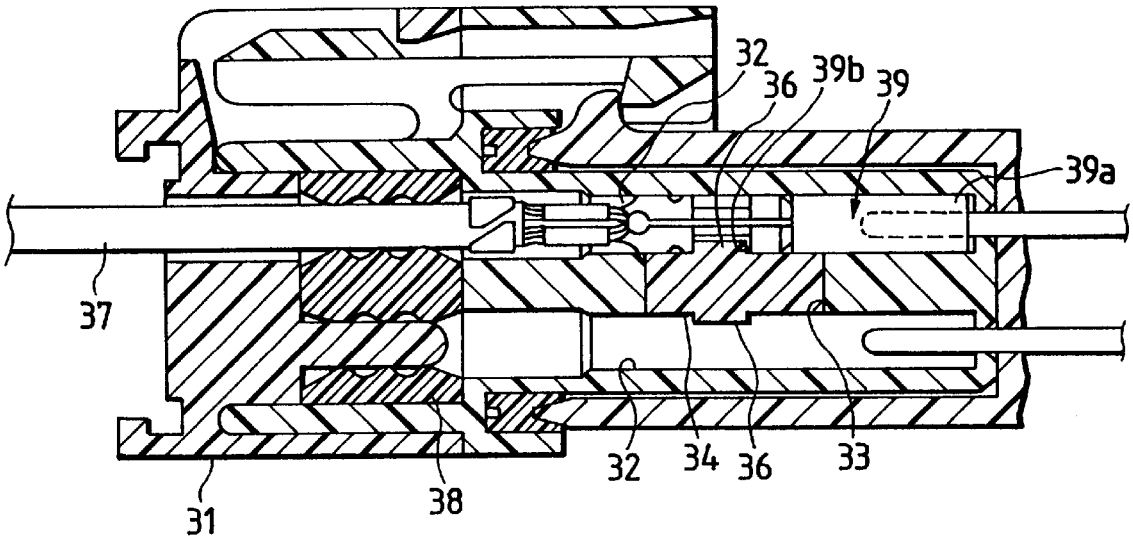
FIG. 8 PRIOR ART
FIG. 8 is a longitudinally sectional view of a conventional electric connector.
Figure 9:
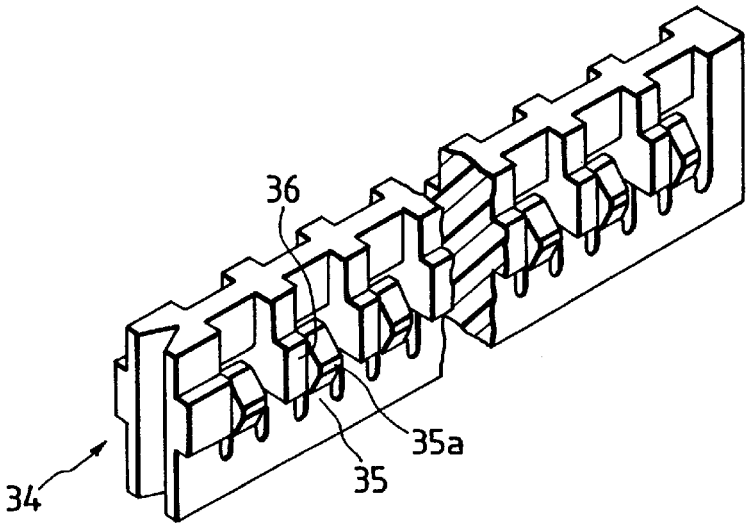
FIG. 9 PRIOR ART
FIG. 9 is a perspective view of a terminal lock member in FIG. 8.
Figure 10A:
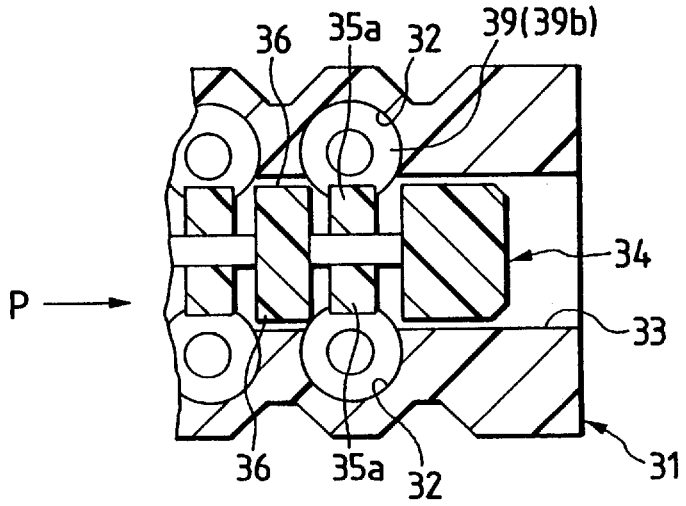
FIG. 10(A) PRIOR ART
FIGS. 10A and 10B are partially sectional views when the terminal lock member in FIG. 9 is in a temporary lock position and in a normal lock position respectively.
Figure 10B:
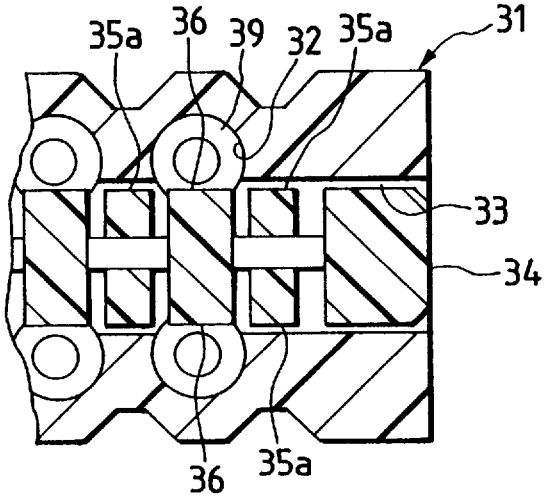
FIG. 10(B) PRIOR ART

In this normal lock position, as shown in FIG. 7A, a terminal in the intermediate portion referenced by the symbol C' is secondarily locked since the center portion of the shoulder portion 27*a* engages with the fixing lock rod 23, the opposite sides of the shoulder portion 27*a* engage with the lock protrusions 20 of different flexible lock arms $\mathbf{19}_1$ and $\mathbf{19}_2$ adjacent to each other respectively, and a terminal C" in the end portion (right side in the drawing) engages with the flexible lock arm $\mathbf{19}_1$ on its one side. In such a manner, each of terminals C, C', C" . . . is locked doubly by the fixing lock rod 23 and one or two flexible lock arms 19, so that a force to hold the terminals is ensured.

As is apparent from FIGS. 6A and 7A, the lock protrusion 20 of the flexible lock arm $\mathbf{19}_1$ having wide width is engaged in the temporary lock position in a condition that the opposite ends of the lock protrusion 20 project over the opposite sides of the circular shoulder portion 27*a*, so that even when the lock protrusion 20 moves to the normal lock position, its rear half portion in the direction of movement thereof is kept engaged with the shoulder portion 27*a*, and in the normal lock position, the opposite sides of the lock protrusion 20 are locked with the different flexible lock arms $\mathbf{19}_1$ and $\mathbf{19}_2$ as in the terminal C'. In such a manner, when the terminal lock member B moves from the temporary lock position to the normal lock position, the engagement between the shoulder portion 27*a* and the flexible lock arm 19 is never released. Therefore, even if a tension is exerted to the electric cable W, it is possible to surely prevent troubles such as detachment of the terminal C, biting the fixing lock rod 23 during movement, and so on.

When it is necessary to remove the terminal C which is locked primarily in the temporary lock position, a jig (not-shown) is inserted into the terminal-pull-out jig insertion hole 6 in FIG. 6A so as to release the engagement between the lock protrusion 20 and the shoulder portion 27*a*, and then the electric cable W is pulled out backward.

When the normal lock state of the terminal lock member B is to be released in the normal lock position, a jig (not-shown) is inserted into the unlock-jig insertion hole 7 in FIG. 7B, the partition plate portion 17 of the lock member body 15 is pushed backward against the elastic force of the elastic lock arm 13 so as to release the engagement between the lock protrusion 14 and the recess portion 25*a*, and then the terminal lock member B is retarded to return to the temporary lock position once.

As has been described above, according to the present invention, a lock protrusion of a flexible lock arm in a terminal lock member is formed so as to be wide enough to engage with two terminals adjacent to each other in the above-mentioned normal insertion position in a normal lock position. Accordingly, the flexible lock arm of the terminal lock member engages with the terminals not only in a temporary lock position but also in the normal lock position so that the terminals are prevented from coming off. Therefore a force to hold the terminals is reinforced, and detachment, damage and so on of the terminals at the time of assembling the electric connector are prevented surely, so that the reliability is improved.

What is claimed is:

1. An electric connector comprising:

a connector housing having a plurality of terminal receiving chambers aligned side by side in at least one lateral row, a through-path formed through one side wall of said housing so as to communicate with said respective terminal receiving chambers;

a terminal lock member inserted into said through-path through two stages of a temporary lock position and a normal lock position, said terminal lock member having flexible lock arms for allowing terminals to be inserted into said terminal receiving chambers at said temporary lock position, having lock protrusions for engaging with said terminals at a normal insertion position to prevent said terminals from coming off, and each of said lock protrusions of said flexible lock arms being formed so as to be wide enough to be engageable with two adjacent terminals which are in said normal insertion position at said normal lock position; and fixing lock rods for engaging with said terminals which are in said normal insertion position at said normal lock position.

2. An electric connector according to claim 1, wherein said terminal lock member includes a lock member body having a side plate portion for closing an opening portion of said through-path, a partition plate portion provided so as to be perpendicular to said side plate portion, and a back plate portion provided at rear ends of said side and partition plate portions, and said flexible lock arms and said fixing lock rods are provided alternately, through slits, from said back plate portion to a front end portion of said partition plate portion.

3. An electric connector according to claim 2 further comprising:

a hook formed, through a notch, on a front end surface of said partition plate portion of said terminal lock member;

a saddle-shaped lock protrusion formed, through a recess portion, on a rear end surface of said partition plate portion;

a lock protrusion provided to project on one side of said through-path to which said terminal lock member inserted; and an elastic lock arm having a lock protrusion provided on the other side of said through-path, wherein said terminal lock member is held in said temporary lock position when said hook on the front end surface of said partition plate portion gets over the lock protrusion in said through-path and the lock protrusion on the rear end surface engages with the lock protrusion of said elastic lock arm, while said terminal lock member is held in said normal lock position when said terminal lock member is further inserted into the inside of said through-path from said temporary lock position and the lock protrusion of said elastic lock arm engages with said recess portion in the rear end surface of said side plate portion.

4. An electric connector according to claim 3, further comprising:

an unlock-jig insertion hole provided so as to extend from the front end surface of said connector housing to the lock protrusion of said elastic lock arm facing said through-path.

5. An electric connector according to claim 1 further comprising:

a plurality of terminal receiving holes are formed side by side in two, upper and lower stages in said connector housing, portions of said terminal receiving holes in front of said through-path are divided into upper and lower sections by a center partition wall, wherein portions of said terminal receiving holes in the rear of said through-path are sectioned by upper and lower partition walls on the opposite side of a cavity portion, said unlock-jig insertion hole is provided in said center partition wall, and said elastic lock arm having the lock protrusion is provided in said cavity portion.

6. An electric connector according to claim 2 further comprising:

a plurality of terminal receiving holes are formed side by side in two, upper and lower stages in said connector housing, portions of said terminal receiving holes in front of said through-path are divided into upper and lower sections by a center partition wall, wherein portions of said terminal receiving holes in the rear of said through-path are sectioned by upper and lower partition walls on the opposite side of a cavity portion, said unlock-jig insertion hole is provided in said center partition wall, and said elastic lock arm having the lock protrusion is provided in said cavity portion.

7. An electric connector according to claim 3 further comprising:

a plurality of terminal receiving holes are formed side by side in two, upper and lower stages in said connector housing, portions of said terminal receiving holes in front of said through-path are divided into upper and lower sections by a center partition wall, wherein portions of said terminal receiving holes in the rear of said through-path are sectioned by upper and lower partition walls on the opposite side of a cavity portion, said unlock-jig insertion hole is provided in said center partition wall, and said elastic lock arm having the lock protrusion is provided in said cavity portion.

8. An electric connector according to claim 4 further comprising:

a plurality of terminal receiving holes are formed side by side in two, upper and lower stages in said connector housing, portions of said terminal receiving holes in front of said through-path are divided into upper and lower sections by a center partition wall, wherein portions of said terminal receiving holes in the rear of said through-path are sectioned by upper and lower partition walls on the opposite side of a cavity portion, said unlock-jig insertion hole is provided in said center partition wall, and said elastic lock arm having the lock protrusion is provided in said cavity portion.

9. An electric connector according claim 5, further comprising:

a guide groove for said side plate portion of said terminal lock member provided in the rear end surface of said center partition wall.

10. An electric connector according claim 6, further comprising:

a guide groove for said side plate portion of said terminal lock member provided in the rear end surface of said center partition wall.

11. An electric connector according claim 7, further comprising:

a guide groove for said side plate portion of said terminal lock member provided in the rear end surface of said center partition wall.

12. An electric connector according claim 8, further comprising:

a guide groove for said side plate portion of said terminal lock member provided in the rear end surface of said center partition wall.

* * * * *